US009343813B2

(12) United States Patent
Zhu

(10) Patent No.: US 9,343,813 B2
(45) Date of Patent: May 17, 2016

(54) ANTENNA WITH HIGH LIGHT TRANSMITTANCE

(75) Inventor: Jeffrey C. Zhu, Ontario (CA)

(73) Assignee: DIGICAN (SHANGHAI) CORP., LTD., Shanghai (CN)

( * ) Notice: Subject to any disclaimer, the term of this patent is extended or adjusted under 35 U.S.C. 154(b) by 176 days.

(21) Appl. No.: 14/358,505

(22) PCT Filed: Dec. 27, 2011

(86) PCT No.: PCT/CN2011/084761
§ 371 (c)(1),
(2), (4) Date: May 15, 2014

(87) PCT Pub. No.: WO2013/033963
PCT Pub. Date: Mar. 14, 2013

(65) Prior Publication Data

US 2014/0327598 A1 Nov. 6, 2014

(30) Foreign Application Priority Data

Sep. 6, 2011 (CN) ..... 2011 1 0262137

(51) Int. Cl.
*H01Q 1/38* (2006.01)
*H01Q 9/04* (2006.01)
*H01Q 1/40* (2006.01)
*H01Q 1/22* (2006.01)

(52) U.S. Cl.
CPC ..... *H01Q 9/0407* (2013.01); *H01Q 1/2283* (2013.01); *H01Q 1/38* (2013.01); *H01Q 1/40* (2013.01)

(58) Field of Classification Search
CPC ..... H01Q 1/2283; H01Q 1/38; H01Q 1/40; H01Q 9/0407
See application file for complete search history.

(56) References Cited

U.S. PATENT DOCUMENTS 8,912,086 B2 * 12/2014 Jo ..... G02F 1/13439 174/389
2009/0051620 A1 2/2009 Ishibashi et al.
2011/0195201 A1 * 8/2011 Zhu ..... H01Q 21/061 427/551
2011/0250402 A1 10/2011 Oldham et al.

FOREIGN PATENT DOCUMENTS

CN 1677744 A 10/2005
CN 1948142 A 4/2007

(Continued)

*Primary Examiner* — Hoang V Nguyen

(74) *Attorney, Agent, or Firm* — Kirton McConkie; Evan R. Witt

(57) ABSTRACT

The present invention provides an antenna with high light transmittance, which includes a transparent substrate and a conducting material. A micro-nanometer groove is formed on a surface of the transparent substrate, and the conducting material is located in the micro-nanometer groove. The antenna with high light transmittance is prepared through a micro-nano processing technology, so that the impact of the conducting material on the light transmittance of the antenna is minimized. The groove has a micro-nanometer width, so that the conducting material is not limited to the transparent conducting materials, but can also be nanometer silver paste. Moreover, by means of the micro-nano processing technology, the antenna with high light transmittance in which the transparent substrate and the conducting material are integrally formed can be obtained; thereby reducing the thickness of the antenna, and the antenna is not easily deformed or damaged.

18 Claims, 2 Drawing Sheets

(56) References Cited

FOREIGN PATENT DOCUMENTS

| | | | |
|---|---|---|---|
| CN | 101180765 | A | 5/2008 |
| CN | 102148429 | A | 8/2011 |
| WO | 2009149125 | A2 | 12/2009 |

* cited by examiner

ANTENNA WITH HIGH LIGHT TRANSMITTANCE

BACKGROUND OF THE INVENTION

1. Field of the Invention

The present invention relates to a transparent antenna, and more particularly to an antenna with high light transmittance including a transparent substrate and a conducting material.

2. Description of the Prior Art

With the development of wireless communication technologies, the antenna as the emitting device is gradually entering into a variety of technical areas, such as, wide applications in mobile phones, satellite receivers, electronic tags, radio cards and other products. With the constant volume reduction of various communication equipments, it is the demand of technical development to develop the antenna which meets the communication requirements without affecting the product beauty. Therefore, the transparent antenna gradually draws the attention of human beings.

Existing transparent antennas are mostly formed by sticking the transparent conducting material in required antenna shape onto transparent insulating material. For example, the transparent antenna mentioned in the Chinese Patent Application No. 200510025416.X could prepare the transparent conducting material into the antennas with different patterns which are installed onto the surface of transparent substrate. However, for the product beauty and without affecting the light transmittance, conducting material of transparent material adopted in this technology is limited to transparent conducting material. The conductivity of existing transparent conducting materials is far less than that of metal. Therefore, the efficiency of such transparent antenna is not high and the performance is relatively poor.

To overcome the influence of antenna width on light transmittance, there is a transparent antenna on the surface of various communication equipments which is composed of a conductive film with mesh structure (the details can refer to Chinese Patent Application No. 200680017569.2). The profile of the mesh is composed of extremely thin shoestring with substantially equal width. The width of extremely thin shoestring can be lower than 30 μm, and the light transmittance is up to above 70%. However, the film and transparent substrate of above mentioned transparent antenna are two separate parts, and the film is installed on the surface of transparent substrate, increasing the antenna thickness. In addition, the film is at the outside of transparent substrate, to prevent antenna pattern damage, additional fixing installation is required; transparent protective film is preferably formed on its surface.

BRIEF SUMMARY OF THE INVENTION

The technical problem to be solved in the present invention is to provide an antenna with high light transmittance, which not only minimizes the influence of the conducting material on the light transmittance, but also integrates a conducting material with a transparent substrate.

To achieve the aforementioned object or other objects of the present invention, the present invention adopts the following technical solution.

An antenna with high light transmittance comprises a transparent substrate and a conducting material. A surface of the transparent substrate is provided with a micro-nanometer groove thereon, and the conducting material is located in the micro-nanometer groove.

Preferably, the surface of the conducting material forms an electrode thereon, and the electrode is located on the micro-nanometer groove containing the conducting material.

Preferably, the transparent substrate is formed by uniformly coating a surface of one transparent material with the other or more transparent materials.

Preferably, the micro-nanometer groove is an interconnected network shape.

Preferably, the interconnected network is a honeycomb network.

Preferably, the conducting material in the micro-nanometer groove forms a conductive network of the antenna with high light transmittance.

Preferably, the conductive network is a planar circuit or a three-dimensional circuit formed by the conducting material.

Preferably, the three-dimensional circuit is formed by overlapping one or more transparent materials on the planar circuit, which is formed by multi-layer conducting materials.

Preferably, the density of the conductive network at a terminal of the antenna is increased. A metal layer is coated on the surface of the conductive network to increase the conductivity performance and improve the welding characteristics.

Preferably, the surface of conductive network is coated with a metal layer for increasing the conductivity performance or improving the welding characteristics. More preferably, the metal layer is firstly coated on the surface of conducting material to increase the conductivity performance and improve the welding characteristics, and then the electrode is formed.

Preferably, the conductive network is located on two opposite surfaces of the transparent substrate.

Preferably, the transparent substrate has a through hole, which is poured with silver paste sintering, to make the conductive network on the two opposite surfaces be mutually connected.

Preferably, in the micro-nanometer groove, a first adhesive layer is first selectively (or all) formed, and the conductive network is formed on the first adhesive layer. The first adhesive layer can partially cover the micro-nanometer groove network, or entirely cover the micro-nanometer groove network.

Preferably, the stickiness of the first adhesive layer is weaker than the bonding strength between the conducting material and the transparent substrate.

Preferably, a second adhesive layer is applied on an exposed surface of the conductive network, and the stickiness of the second adhesive layer is higher than the bonding strength between the conductive network and the transparent material or the bonding strength between the conductive network and the first adhesive layer.

Preferably, a terminal of the conductive network is connected with an antenna connector, and can receive/send circuit via the antenna connector.

A terminal of the conductive network is directly connected with a chip, and the chip is embedded into a preset recess of the transparent substrate.

The antenna can feed in radio frequency signal through capacitance coupling method.

Preferably, the conducting material is nanometer silver paste.

The present invention is an antenna with high light transmittance, which is prepared through a micro-nanometer processing technology. The groove has a micro-nanometer width, so that the conducting material is not limited to the transparent conducting materials, but can also be nanometer silver paste. In addition, by means of the micro-nanometer processing technology, the antenna with high light transmittance, in which the transparent substrate and the conducting material are integrally formed, can be obtained; thereby reducing the thickness of the antenna, and the antenna is not easily deformed like the exposed antenna.

Figure 1:
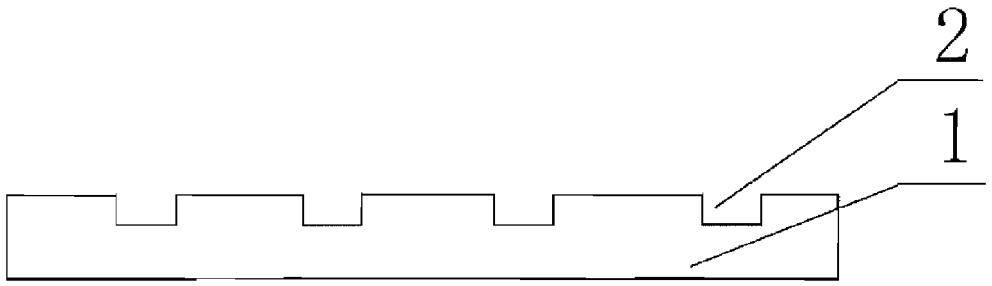
FIG. 1 is a transparent substrate provided with a micro-nanometer groove on a surface thereof.

The reference numerals in the drawings are described as follows:

1 transparent substrate
2 micro-nanometer groove
3 conducting material
4 first transparent material
5 second transparent material
6 conductive network
7 electrode
8 chip
9 transparent adhesive tape
10 weak sticky transparent adhesive

DETAILED DESCRIPTION OF THE PREFERRED EMBODIMENTS

The following text will take a preferred embodiment of the present invention with reference to the accompanying drawings for detail description as follows.

The present invention relates an antenna with high light transmittance, which includes a transparent substrate 1 and a conducting material 3. Wherein, the transparent substrate 1 is provided with a micro-nanometer groove 2 on the surface thereof, and a conducting material 3 is located in the micro-nanometer groove 2.

The transparent substrate 1 can be a transparent material. FIG. 1 is a structure schematic view of the transparent substrate provided with the micro-nanometer groove on the surface thereof. Common transparent materials being capable of being applied in the present invention may be plastic, composite, polyethylene, polycarbonate, polymethyl methacrylate, glass and plexiglass etc..

Figure 3:
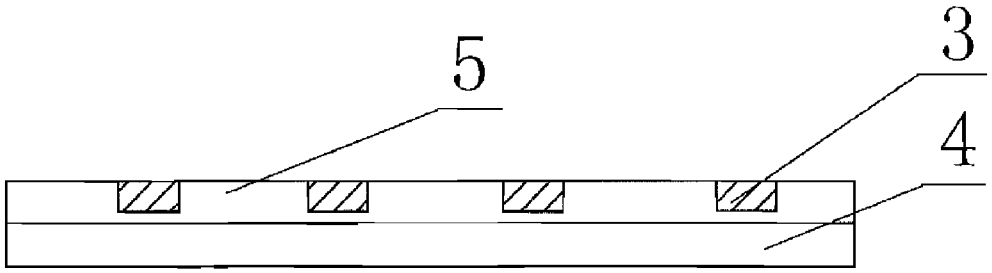
FIG. 3 is an internal structure schematic view of Example 2 of the antenna with high light transmittance.

The transparent substrate 1 can be formed by uniformly coating a surface of one transparent material with the other or more transparent materials. Especially, when the transparent material could not go through pressed processing, the transparent substrate 1, which could go through pressed processing, can be obtained by applying a second transparent material 5 to a surface of a first transparent material 4. That is, the transparent substrate 1 has the structure as shown in FIG. 3. Preferably, the second transparent material 5 located on the top may be a transparent adhesive. The common transparent adhesives used in the present invention include UV curable adhesive, curing amine or other transparent adhesive materials, one of which can be used or several of which can be mixed used.

Figure 4:
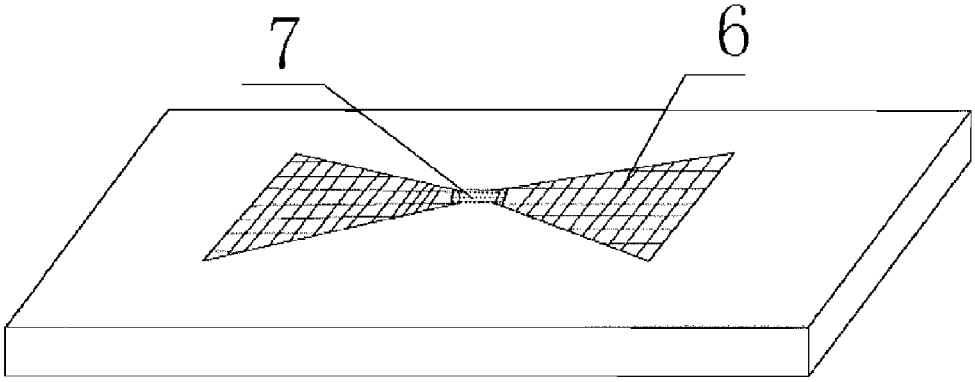
FIG. 4 is a perspective view of the bipolar antenna with high light transmittance.

The micro-nanometer groove 2 can be formed on the surface of the transparent substrate 1 by pressing or etching process. The micro-nanometer groove 2 is distributed on the surface of the transparent substrate 1 in a network shape, which is mutually connected and located in a certain region. The region shape is preferred to be the shape of an antenna conductive part. As shown in FIG. 4, in the bipolar antenna with high light transmittance as shown in this example, two mutually symmetrical groove network patterns are formed on the surface of the transparent substrate 1 by pressing or etching process. A triangular region as shown in FIG. 4 is the region where the antenna conductive part is located.

Figure 2:
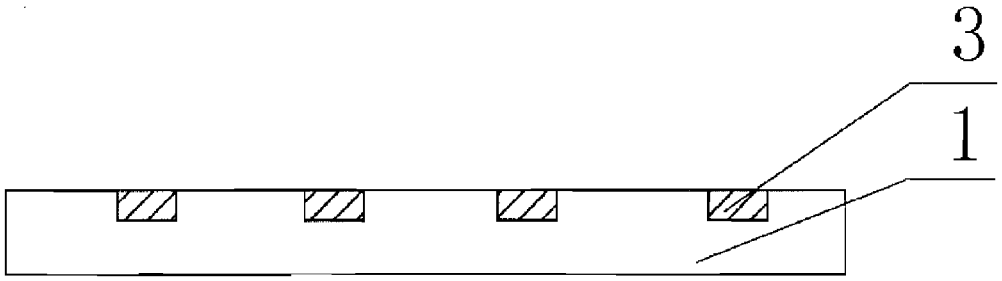
FIG. 2 is an internal structure schematic view of Example 1 of an antenna with high light transmittance.

In the micro-nanometer groove 2, the conducting material 3 can be poured through rubbing or immersion to form a conductive network 6. The conducting material 3 can be nanometer silver paste or other conducting materials. Referring to internal structure schematic views as shown in FIGS. 2 and 3, in the micro-nanometer groove 2 on the surface of the transparent substrate 1, the nanometer silver paste is poured through rubbing and immersion, thereby forming the antenna with high light transmittance integrated with the transparent substrate.

In addition, the conductive network 6 can be a planar or three-dimensional circuit. The planar or three-dimensional circuit, which is composed of the conducting material 3 and formed on the surface of the transparent substrate 1, can construct an electrical connection with external equipment, and can provide support for the signal receiving and radiation.

The conductive network 6 can be located on one surface of the transparent substrate 1, or on two opposite surfaces of the transparent substrate 1. The conductive network 6 located on the two opposite surfaces of the transparent substrate 1 can be electrically communicated with each other by punching the substrate 1 and pouring silver paste sintering in a through hole. The through hole may consist of several tiny holes.

To reduce the electrical loss between the antenna and external circuit, one terminal of the antenna near an external circuit can be connected with an electrode, thereby avoiding current concentration in the antenna. Preferably, the micro-nanometer groove 2 containing the conducting material 3 can be coated with copper or aluminum to form the electrode. The micro-nanometer groove 2 containing conducting material 3 can also go through conductive growth or secondary silver pouring to form the electrode. In the bipolar antenna with high light transmittance as shown in FIG. 4, an electrode 7 is formed via copper plating in the middle region of two conductive networks 6, namely in the connecting region of two triangle antennas and external equipment, thereby realizing a contact connection between the antenna and the electrode.

More preferably, the density of the conductive network 6 at the antenna terminal can be increased, and the surface thereof can be coated with a metal layer, thereby increasing the conductivity performance and improving welding characteristics, and then forming the mentioned electrode.

Figure 5:
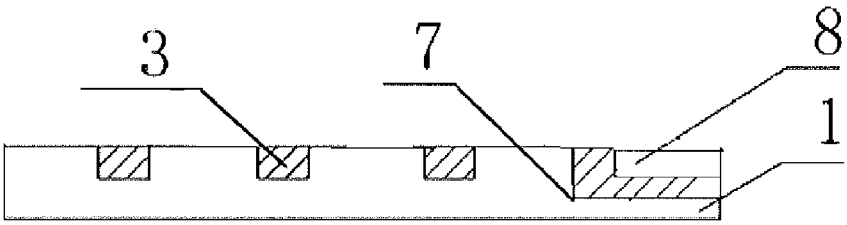
FIG. 5 is a partial sectional view of the antenna with high light transmittance as shown in FIG. 4.
Figure 6:
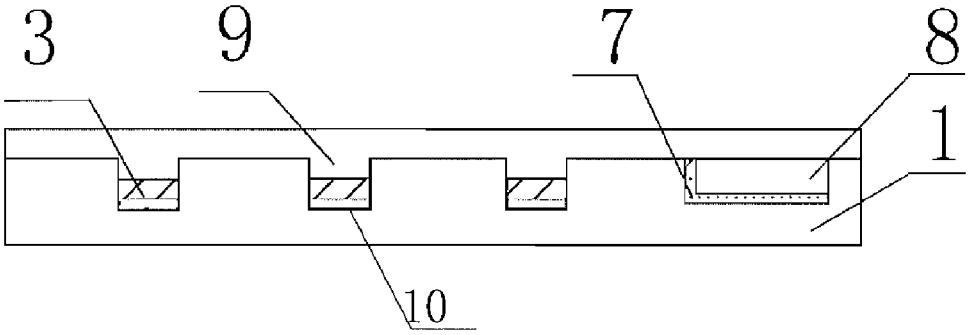
FIG. 6 is a sectional view of an electronic tag made by the antenna with high light transmittance.

FIG. 5 is a sectional view of the electrode as shown in FIG. 4. The conducting materials 3 are located in the micro-nanometer groove on the surface of the transparent substrate 1, and the electrode 7 is formed on the surface of the conducting materials 3 via copper plating. In addition, a chip 8 can be embedded in a preset recess of the transparent substrate. The electrical connection between the chip 8 and the electrode 7 can achieve the information exchange between the antenna and the chip 8. The typical application example is an electronic tag as shown in FIG. 6. In this application example, a conductive adhesive is dropped on the surface of the electrode 7, and an electrode of the chip 8 is attached on the electrode 7 to form the electronic tag. In addition, a transparent adhesive tape 9 is attached on the surface of the chip 8 and the micro-nanometer groove 2 for sealing. By attaching the electronic tag as shown in FIG. 6 onto the product, the product can be identified through the exchange information between the electronic tag and the external equipment.

In the micro-nanometer groove 2, a weak sticky transparent adhesive 10 first forms a first adhesive layer, and then the conductive network 6 is formed on the first adhesive layer. The stickiness of the first adhesive layer is weaker than the bonding strength between the conducting material 3 and the transparent substrate 1. In addition, a second adhesive layer (namely the transparent adhesive tape 9) is applied to an exposed surface of the conductive network 6. The stickiness of the second adhesive layer is higher than the bonding strength between the conductive network 6 and the transparent material, or the bonding strength between the conductive network 6 and the first adhesive layer. Thus, when the antenna is stuck onto other object's surface, the conductive network will be destroyed if it is compulsorily removed.

In the antenna with high light transmittance provided by the present invention, the groove has a micro-nanometer width, so that the conducting material is not limited to the transparent conducting materials, but can also be nanometer silver paste. Because the conducting material is extremely thin, the impact on light transmittance can be reduced. When the light penetrates the transparent substrate 1, under the effect of the conducting material 3, it is similar to diffraction, thus improving the light transmittance.

Furthermore, by means of the micro-nanometer process technology, the antenna with high light transmittance, in which the transparent substrate and the conducting material are integrally formed, can reduce the thickness of the antenna, and the antenna is not easily deformed like the exposed antenna. Such antenna with high light transmittance can be applied to a patch antenna, a level flight bipolar antenna and a reflecting antenna, thus the antenna can be directly attached onto a display screen or the object's surface requiring light transmittance, achieving the design purpose of the antenna with high light transmittance.

The above describes the antenna with high light transmittance provided by the present invention in details. For a person skilled in the art, he can make all sorts of improvements and amendments within the principles of the present invention, which will violate the patent for invention and will bear the corresponding legal responsibility.

What is claimed is:

1. An antenna with high light transmittance, comprising a transparent substrate and a conducting material, characterized in that: a surface of the transparent substrate being provided with a micro-nanometer groove thereon, and the conducting material being located in the micro-nanometer groove; the surface of the conducting material forming an electrode thereon, and the electrode being located on the micro-nanometer groove containing the conducting material.

2. The antenna with high light transmittance as claimed in claim 1, characterized in that: the transparent substrate is formed by uniformly coating a surface of one transparent material with the other or more transparent materials.

3. The antenna with high light transmittance as claimed in claim 1, characterized in that: the micro-nanometer groove is an interconnected network shape.

4. The antenna with high light transmittance as claimed in claim 3, characterized in that: the interconnected network is a honeycomb network.

5. The antenna with high light transmittance as claimed in claim 4, characterized in that: the conducting material in the micro-nanometer groove forms a conductive network of the antenna with high light transmittance.

6. The antenna with high light transmittance as claimed in claim 5, characterized in that: the conductive network is a planar circuit or a three-dimensional circuit formed by the conducting material.

7. The antenna with high light transmittance as claimed in claim 6, characterized in that: the three-dimensional circuit is formed by overlapping one or more transparent materials on the planar circuit, which is formed by multi-layer conducting materials.

8. The antenna with high light transmittance as claimed in claim 5, characterized in that: the density of the conductive network at a terminal of the antenna is increased.

9. The antenna with high light transmittance as claimed in claim 5, characterized in that: the surface of conductive network is coated with a metal layer.

10. The antenna with high light transmittance as claimed in claim 5, characterized in that: a first adhesive layer is firstly formed in the micro-nanometer groove, and then the conductive network is formed on the first adhesive layer.

11. The antenna with high light transmittance as claimed in claim 10, characterized in that: the stickiness of the first adhesive layer is weaker than the bonding strength between the conducting material and the transparent substrate.

12. The antenna with high light transmittance as claimed in claim 10, characterized in that: a second adhesive layer is applied on an exposed surface of the conductive network, and the stickiness of the second adhesive layer is higher than the bonding strength between the conductive network and the transparent material or the bonding strength between the conductive network and the first adhesive layer.

13. The antenna with high light transmittance as claimed in claim 5, characterized in that: the conductive network is located in the grooves on two opposite surfaces of the transparent substrate.

14. The antenna with high light transmittance as claimed in claim 13, characterized in that: the transparent substrate has a through hole, which is poured with silver paste sintering, to make the conductive network on the two opposite surfaces be mutually connected.

15. The antenna with high light transmittance as claimed in claim 5, characterized in that: a terminal of the conductive network is connected with an antenna connector, and can receive/send circuit via the antenna connector.

16. The antenna with high light transmittance as claimed in claim 5, characterized in that: a terminal of the conductive network is connected with a chip, and the chip is embedded into a preset recess of the transparent substrate.

17. The antenna with high light transmittance as claimed in claim 5, characterized in that: the antenna can feed in radio frequency signal through capacitance coupling method.

18. The antenna with high light transmittance as claimed in claim 1, characterized in that: the conducting material is nanometer silver paste.

* * * * *